United States Patent [19]

Schuetzeberg et al.

[11] Patent Number: 4,659,129

[45] Date of Patent: Apr. 21, 1987

[54] SKI CARRIER WITH LOCK

[76] Inventors: Roy L. Schuetzeberg, 3206 67th St., Lubbock, Tex. 79413; Jerome H. Schuetzeberg, 5703 37th St., Lubbock, Tex. 79416

[21] Appl. No.: 833,907

[22] Filed: Feb. 26, 1986

[51] Int. Cl.[4] ..... A63C 11/02

[52] U.S. Cl. ..... 294/147; 294/163; 294/165

[58] Field of Search ..... 294/147, 141, 142, 143, 294/146, 149, 151, 153, 154, 159, 161, 162, 163, 164, 165, 167, 169, 170; 211/70.5; 224/917; 280/814, 815

[56] References Cited

U.S. PATENT DOCUMENTS 4,310,190 1/1982 Schuetzeberg et al. ..... 294/147

4,479,674 10/1984 Nordmeyer ..... 294/147

*Primary Examiner*—James B. Marbert

*Attorney, Agent, or Firm*—Wendell Coffee

[57] ABSTRACT

A bicycle type cable lock is attached to the pivot means of a ski carrier. The cable lock can be used to secure a pair of skis and poles to a permanent structure when they are attached to the ski carrier. The cable lock also can be used to secure the ski carrier by itself to a permanent structure such as a tree.

2 Claims, 6 Drawing Figures

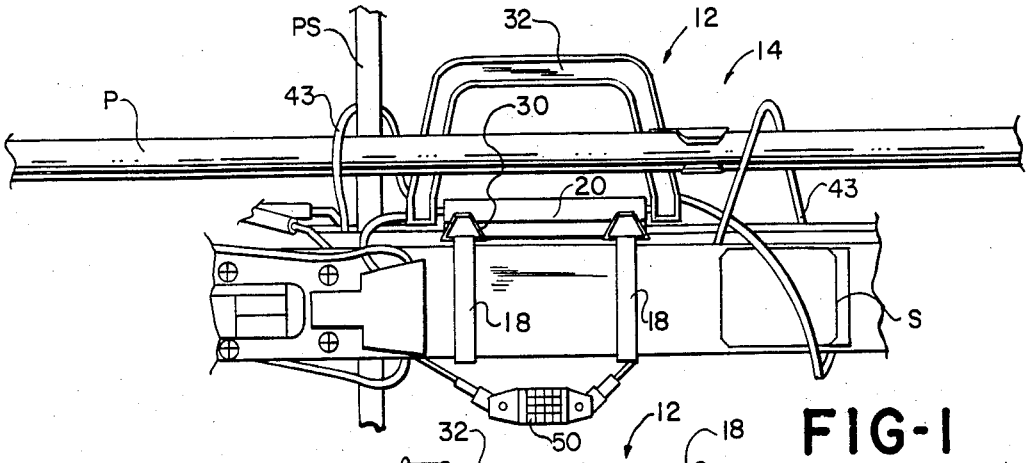
FIG-1
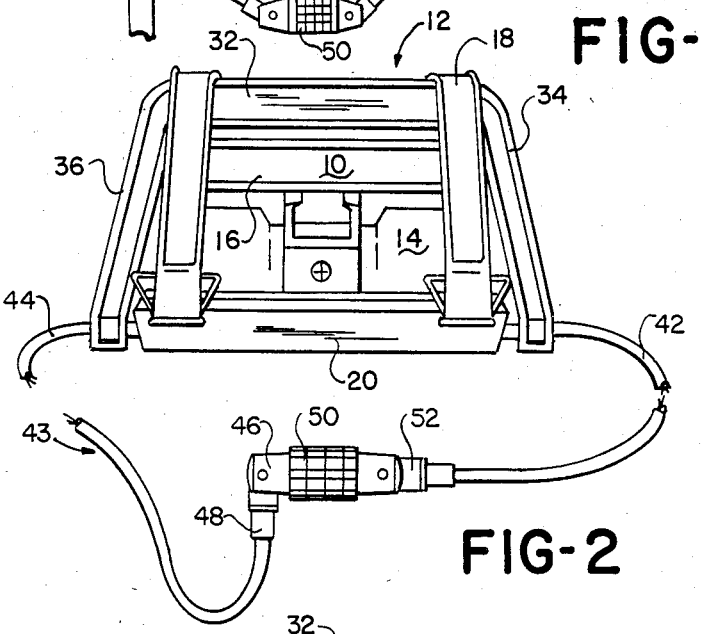
FIG-2
FIG-3
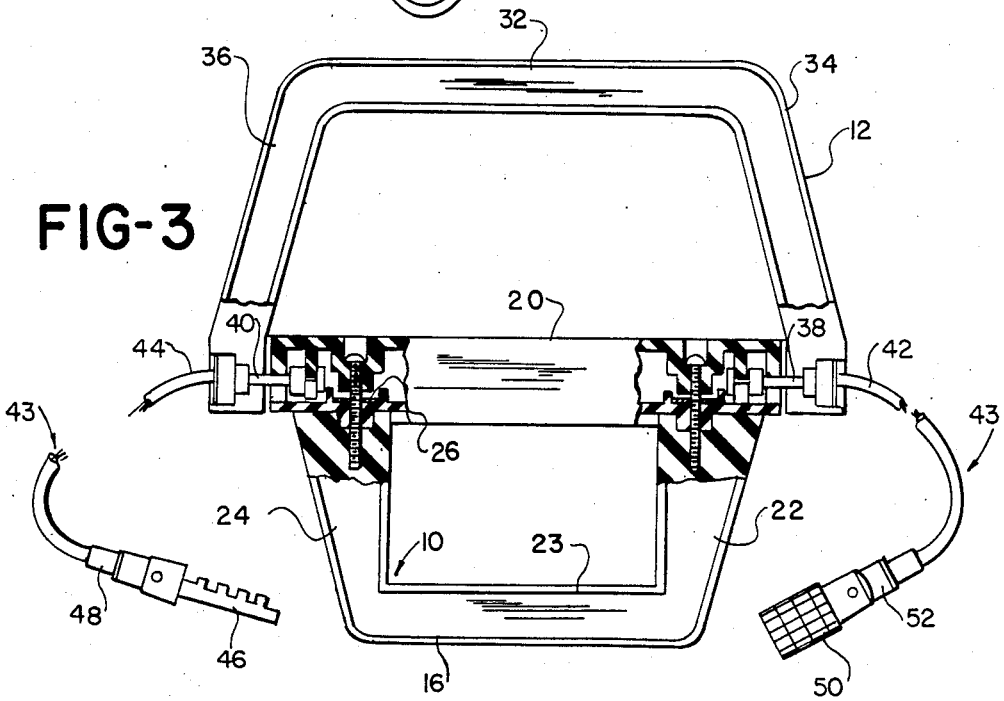

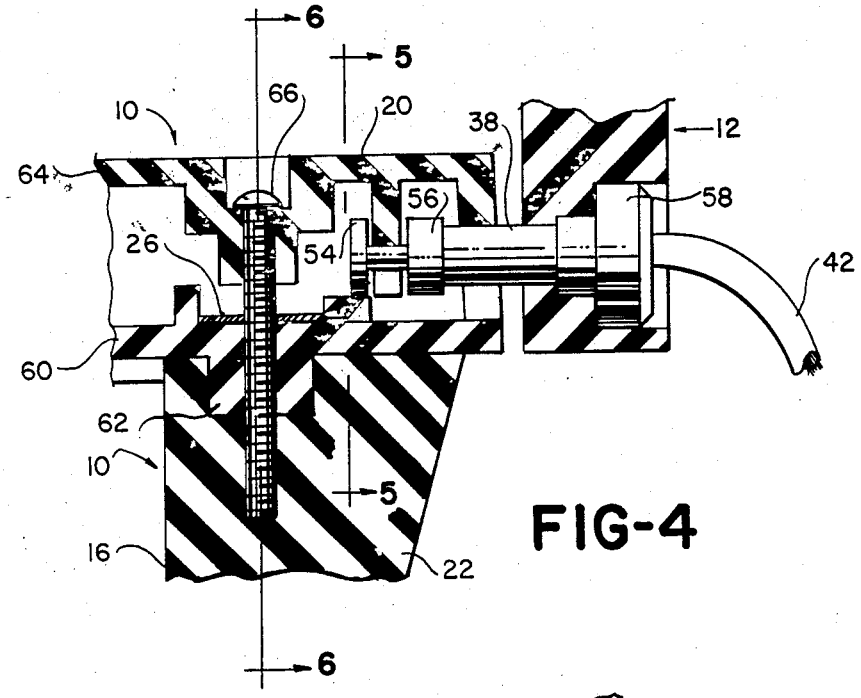
FIG-4
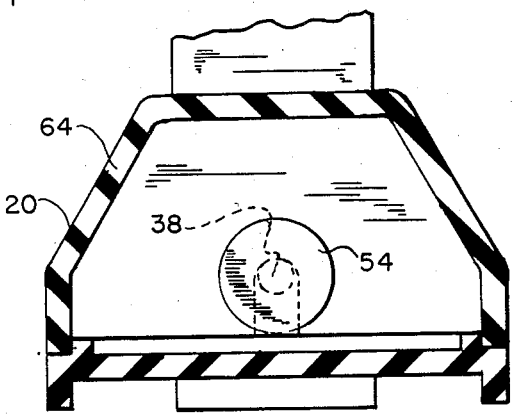
FIG-5
FIG-6
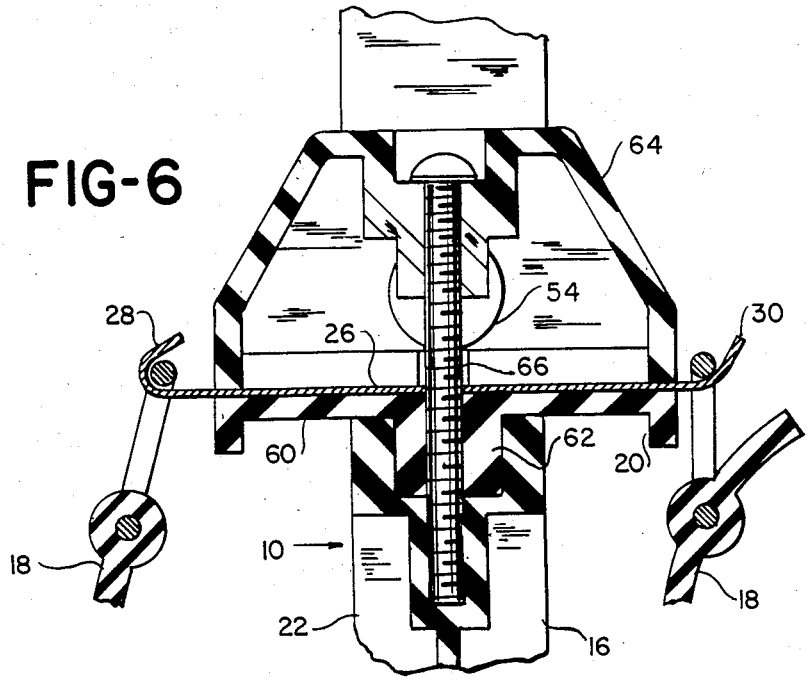

SKI CARRIER WITH LOCK

BACKGROUND OF THE INVENTION (1) Field of the Invention

This invention relates to sporting equipment and more particularly to a lock on a carrier for skis for keeping the skis safe.

(2) Description of Related Art

This invention is an improvement on our SKI and SKI POLE CARRYING APPARATUS, as disclosed in U.S. Pat. No. 4,310,190.

Other ski carriers have been provided with means by which they could be locked to trees, posts, rails, or the like.

Also, before our invention, cable type bicycle locks were known. A cable type bicycle lock includes a cable which has a lock bolt on one end and a lock means on the other for releasably locking the bolt into the lock means.

SUMMARY OF THE INVENTION

New and Different Function

We have invented a simple lock attachment by which the skis when attached to our ski carrier can be readily locked to a tree, rail, post or other permanent structure for keeping the skis safe. Other skiers can neither mistakenly carry the skis away thinking that they are their own nor easily intentionally steal the same.

We have achieved this result by the use of a simple cable type lock. The cable is securely and permanently fastened to the pivot pins of the carrier so that the lock is always present with the ski carrier. Thus, while the skier is participating in his sport he may easily put the carrier with the lock in his pocket so that it is always readily available when he wishes to remove his skis and lock them while he goes into a lodge for refreshment or any other reason.

Also, if the skier knows that he is going to return to the same point from which he started, he can use the lock to lock the carrier to some permanent structure so that he does not have the carrier on his person with him, although because of its size and weight it is convenient for him to have it with him at all times.

Thus it may be seen that the total function of our invention far exceeds the sum of the functions of the individual parts such as handles, pivots, cables, etc.

Objects of this Invention

An object of this invention is to provide a lock readily available to keep a pair of skis safe or to keep the carrier for carrying a pair of skis safe if the skis are not attached to the carrier.

Further objects are to achieve the above with a device that is sturdy, compact, durable, lightweight, simple, safe, efficient, versatile, ecologically compatible, energy conserving, and reliable, yet inexpensive and easy to manufacture, maintain, carry, and attach.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 1 is an elevational view of the ski carrier with lock according to this invention attached to skis in the locking position.

FIG. 2 is an elevational view of the ski carrier with lock according to this invention in the folded position.

FIG. 3 is an elevational view of the ski carrier and and lock showing a portion of the cables of the lock, with parts in section.

FIG. 4 is a sectional partial view showing the pin connection.

FIG. 5 is a sectional view taken on line 5—5 of FIG. 4.

FIG. 6 is a sectional view taken on line 6—6 of FIG. 4.

As an aid to correlating the terms describing this invention to the exemplary drawing the following catalog of elements is provided:

CATALOG OF ELEMENTS

10 ski holder assembly
12 handle assembly
14 ski pole assembly
16 holder frame
18 resilient bands
20 base
22 vertical front bar
23 horizontal leg
24 vertical rear bar
26 metal clip
28 loop
30 hook
32 horizontal arm
34 front vertical arm
36 rear vertical arm
38 forward pin part
40 rear pin part
42 forward cable part
43 cable
44 rear cable part
46 lock bolt
48 socket connection
50 lock means
52 socket connection
54 medial knob
56 medial protrusion
58 distal knob
60 frame base
62 boss
64 cover
66 bolt
S Skis
P Poles
PS Permanent structure

DESCRIPTION OF THE PREFERRED EMBODIMENT

Referring to the drawings there may be seen a ski carrying assembly which is almost identical to the assembly shown in our U.S. Pat. No. 4,310,190. Specifically the ski carrying assembly has the main elements of the ski holder assembly 10, the handle assembly 12, and the ski pole holder assembly 14.

The ski holder assembly includes the ski holder frame 16 and two resilient bands 18.

The holder frame includes a rigid horizontal extending base 20, a rigid vertically extending front bar 22, and a rigid vertically extending rear bar 24. The vertical bars 22 and 24 ar rigidly and firmly joined at one end to either end of the horizontal base 20. The other end of the vertical bars 22 and 24 are rigidly and integrally connected to the horizontal leg 23.

Each of the resilient bands 18 are attached to the base 20 by a metal clip 26. The clip has loop 28 on one end and hook 30 on the other end. The loop 28 forms means for attaching one end of each resilient band 18 to the base 20. Therefore the resilient band can be extended around the skis "S" to the hook 30. Therefore the hook 30 forms means supported on the base for attaching the end of the resilient bands to the base and to release the resilient bands from the base.

The handle assembly 12 includes rigid horizontally extending arm 32. Rigid front vertically extending arm 34 and rigidly rear vertically extending arm 36 are attached to either end of the horizontal arm 32.

Pivot means is rigidly attached to each end of the holder base 20. The pivot means is a means attached to the holder frame for pivotally attaching the handle 12 to the holder frame 16. The pivot means has two parts: rear pin part 40 and forward pin part 38. The forward pin part is attached to the base adjacent to the vertical front bar 22 and the rear pin part 40 is attached near the vertical rear bar 24. The pins from each end are coaxially. The pin part 38 extends through the distal end of the forward vertical arm 34 and the pin part 40 that extends rearwardly extends through the distal end of the rear vertical arm 36. Therefore it may be seen that the handle assembly 12 is pivotably connected to the ski holder assembly 10 at the ski holder frame 16.

The axis of the pin parts 38 and 40 form a longitudinal axis. The vertically extending arms 34 and 36 extend in an angle inasmuch as the horizontal arm 32 is of lesser length than the base 20 of the holder frame 16.

Pole holder assembly 14 for poles "P" forms no part of this invention. It is present in the complete device but reference is made to our former patent for a more detailed description of this element.

Those having ordinary skill in the art will understand that the invention as described to this point is old, disclosed in our prior patent, and commercially available on the market.

To the assembly described at this point, we have modified the parts to add the lock.

Specifically to the pin parts 38 and 40 we have attached forward cable part 42 and rear cable part 44. The two cable parts 42 and 44 are two parts of single cable 43. The forward cable part 42 is permanently and securely attached to the forward pin part 38 and the rear cable part 44 is permanently and securely attached to the rear pin part 40.

Lock bolt 46 is pivoted to socket connection 48 which is securely permanently attached to the distal end of the rear cable part 44.

Lock means 50 is pivoted to socket connection 52 which is securely permanently attached to the distal end of forward cable part 44. The lock bolt and lock means are parts of common bicycle locks. I.e., the lock means 50 forms a means for releasably locking the lock bolt 46 thereto so that when the two parts are connected that the cable 43 is effectively locked into a single loop. The two pin parts could be considered a single pin with two parts; just as the two parts of the cable can be thought of as a single cable in two parts. for reasons of manufacture we prefer to use two separate pin parts with the pin parts securely attached to the end of the cable so that they might be considered a terminal end of that part of the cable. It might be considered that the single cable consisting of the two parts 42 and 44 are secured to the ski carrying assembly which includes ski holder 10 and handle 12. The cable is secured to the ski carrying assembly by the pivot means which includes the two parts 38 and 40.

Each of the pin parts 38 and 40 include medial knob 54 and medial protrusion 56. Also each of the pin parts 38 and 40 includes a distal knob 58 at which point the cable parts are attached.

In actual manufacture the base 20 is composed of two parts, a frame base 60 which attaches from one bar 22 to the other bar 24. A boss 62 on the frame base 60 fits within a bore extending longitudinally of each bar 22 and 24 to register the frame base 60 with each of the bars 22. Cover 64 fits onto the frame base and includes a bolt bore through which bolt 66 extends. The bolt 66 extends not only through the cover but also through the metal clip 26, the boss 62, and has threads on its extremity by which it is threaded into the bars 22 and 24.

At the pin parts 38 and 40, the base 60 and the cover 64 have grooves and flanges to securely fit the pin parts but also to prevent the axially movement of the pin parts 38 and 40. That is the knob 54 and the protrusion 56 fit within the flange to prevent the pins from being pulled out of the holder (FIG. 4) Likewise, the distal knob 58 prevents axial movement of the handle assembly 12.

Thus it may be seen that we have provided a simple convenient lock means so that either the ski carrier may be locked to a permanent structure "PS" when detached from the skis or that the skis when attached to the ski handle may be securely attached to a permanent structure. Those having ordinary skill with skis will understand that the cable can be wrapped and looped around the skis at the foot piece of the binding of the skis so that the skis cannot be removed when the cable is thus looped around them.

Although normally the loss of the poles "P" is not a problem, the cable likewise can be looped around them to secure the poles to some permanent structure "PS".

The embodiment shown and described above is only exemplary. we do not claim to have invented all the parts, elements, or steps described. Various modifications can be made in the construction, material, arrangement, and operation, and still be within the scope of our invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A ski carrying assembly having a. a ski holder frame, b. a resilient band attached to said frame, c. a pair of skis with bindings having foot pieces strapped by the band to the frame, d. a handle, and e. a forward pin part and a rear pin part on the holder frame for pivoting the handle to the holder frame;

wherein the improvement comprises:

f. a forward cable part secured to the forward pin part, g. a rear cable part secured to the rear pin part, h. a lock bolt on one of the cable parts, i. a lock means on the other of the cable parts for releasably locking to the lock bolt, j. each of said pin parts include knobs and protrusions which fit with flanges on the holder to prevent the pin parts being pulled from the holder, and k. said cable wrapped and looped around the skis at the foot pieces of the binding of skis so that the skis cannot be removed when the cable is looped around them.

2. A ski carrying assembly comprising a ski holder assembly and a handle assembly, having:

a. the ski holder assembly comprising a ski holder assembly frame and a resilient band, b. said ski holder assembly frame comprising a rigid horizontally extending base, a rigid vertically extending front bar and a rigid vertically extending rear bar firmly joined together and outlining a ski holder assembly frame enclosure, said band attached to said base, c. said ski holder assembly base comprising a horizontally extending rigid pivot means attached to and projecting forward and rearward from said base, hook means supported on said base and said resilient band attached to said base and releasably attached to said hook means, d. said handle assembly comprising a rigid horizontally extending arm, a rigid front vertically extending arm and a rigid rear vertically extending arm, said vertically extending arms each connected at one end thereof to said horizontally extending arm and, at the other end thereof, pivotally attached to one end of said base, said horizontally extending arm and said front and rear arms and said base outlining a handle enclosure space, said handle assembly and said ski holder assembly pivotally connected to each other for pivotal movement around a longitudinal axis passing through said pivot means, said vertically extending arms extending at an angle to said longitudinal axis passing through said pivot means;

wherein the improvement comprises:

e. a cable having two lock ends secured to the ski carrying assembly by said pivot means, f. a lock bolt on one lock end of the cable, g. a lock means on the other lock end of the cable for releasably locking to the lock bolt, h. said pivot means is in two parts namely a forward pin part and a rear pin part, i. said cable is in two parts namely a forward cable part and a rear cable part, j. the forward cable part is secured to the forward pin part and the rear cable part is secured to the rear pin part, k. the lock bolt is on one cable part and the lock means is on the other cable part and l. each of said pin parts include knobs and protrusions which fit with flanges on the holder to prevent the pin parts being pulled from the holder.

* * * * *